US012262800B1

(12) United States Patent
Tung

(10) Patent No.: US 12,262,800 B1
(45) Date of Patent: Apr. 1, 2025

(54) CANTILEVER UMBRELLA

(71) Applicant: Po-Lung Tung, Tainan (TW)

(72) Inventor: Po-Lung Tung, Tainan (TW)

( * ) Notice: Subject to any disclaimer, the term of this patent is extended or adjusted under 35 U.S.C. 154(b) by 0 days.

(21) Appl. No.: 18/916,453

(22) Filed: Oct. 15, 2024

(51) Int. Cl.
*A45B 23/00* (2006.01)

(52) U.S. Cl.
CPC ..... *A45B 23/00* (2013.01); *A45B 2023/0037* (2013.01)

(58) Field of Classification Search
CPC ..... A45B 2023/0031; A45B 2023/0037
See application file for complete search history.

(56) References Cited

U.S. PATENT DOCUMENTS 6,435,444 B1 * 8/2002 Lin ..... B65H 75/4428 242/395
7,886,755 B2 * 2/2011 Tung ..... A45B 23/00 135/21
8,104,492 B2 * 1/2012 Dan ..... A45B 25/14 135/21
9,220,325 B2 * 12/2015 Ma ..... A45B 23/00
9,930,942 B2 * 4/2018 Ma ..... A45B 23/00
10,136,709 B2 * 11/2018 Ma ..... A45B 23/00
11,266,212 B2 * 3/2022 Jin ..... A45B 17/00

* cited by examiner

*Primary Examiner* — Noah Chandler Hawk
(74) *Attorney, Agent, or Firm* — Birch, Stewart, Kolasch & Birch, LLP

(57) ABSTRACT

A cantilever umbrella has a pole, a slider, a handle mechanism, a support arm, and an umbrella body. The slider is disposed on the pole. The handle mechanism has a connecting rack, a handle seat, and a handle assembly. The connecting rack is fixed to the slider. The handle seat is an independent component outside the slider and is rotatably mounted to the connecting rack. The handle assembly is disposed to the handle seat and is operable to rotate relative to the handle seat. The support arm is connected to the handle seat. The umbrella body is disposed on the support arm and connected with the handle assembly via a cord. The handle seat and the handle assembly disposed outside the slider simplify the assembling of the cantilever umbrella.

10 Claims, 9 Drawing Sheets

CANTILEVER UMBRELLA

BACKGROUND OF THE INVENTION

1. Field of the Invention

The present invention relates to an umbrella, and particularly to a cantilever umbrella.

2. Description of Related Art

A conventional cantilever umbrella has a pole, a slider, a cantilever component, and an umbrella body. The slider is slidably disposed on the pole and connected to the umbrella body via an arm of the cantilever component. An angle of the umbrella body can be adjusted by the slider sliding along the pole.

To open and close the umbrella body, the conventional cantilever umbrella has a shaft disposed in the slider and a handle connected to the shaft. Then, a cord is wound on the shaft and connected to the umbrella body. By rotating the handle, the shaft is driven to rotate so as to release or retract the cord, and the umbrella body can thus be opened or closed.

However, when assembling the conventional cantilever umbrella, the shaft and other components need to be mounted inside the slider without interfering with each other. Assembling of the conventional cantilever umbrella is limited in a small space and is thus troublesome. Also, the cord from the shaft to the umbrella body may need to be bent to avoid other components inside the slider. Therefore, it can be difficult to release and retract the cord smoothly.

To overcome the shortcomings of the conventional cantilever umbrella, the present invention tends to provide a cantilever umbrella to mitigate or obviate the aforementioned problems.

SUMMARY OF THE INVENTION

The main objective of the present invention is to provide a cantilever umbrella to improve convenience of assembling and allow its umbrella body to be opened and closed more smoothly.

The cantilever umbrella has a pole, a slider, a handle mechanism, a support arm, and an umbrella body. The slider is disposed on the pole, configured to be locked on the pole, and configured to be unlocked and slide along the pole. The handle mechanism has at least one connecting rack, a handle seat, and a handle assembly. The at least one connecting rack is fixed to the slider. The handle seat is an independent component outside the slider and is rotatably mounted to the at least one connecting rack. The handle assembly is disposed to the handle seat and is operable to rotate relative to the handle seat. The support arm is connected to the handle seat. The umbrella body is disposed on the support arm and connected with the handle assembly via a cord.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
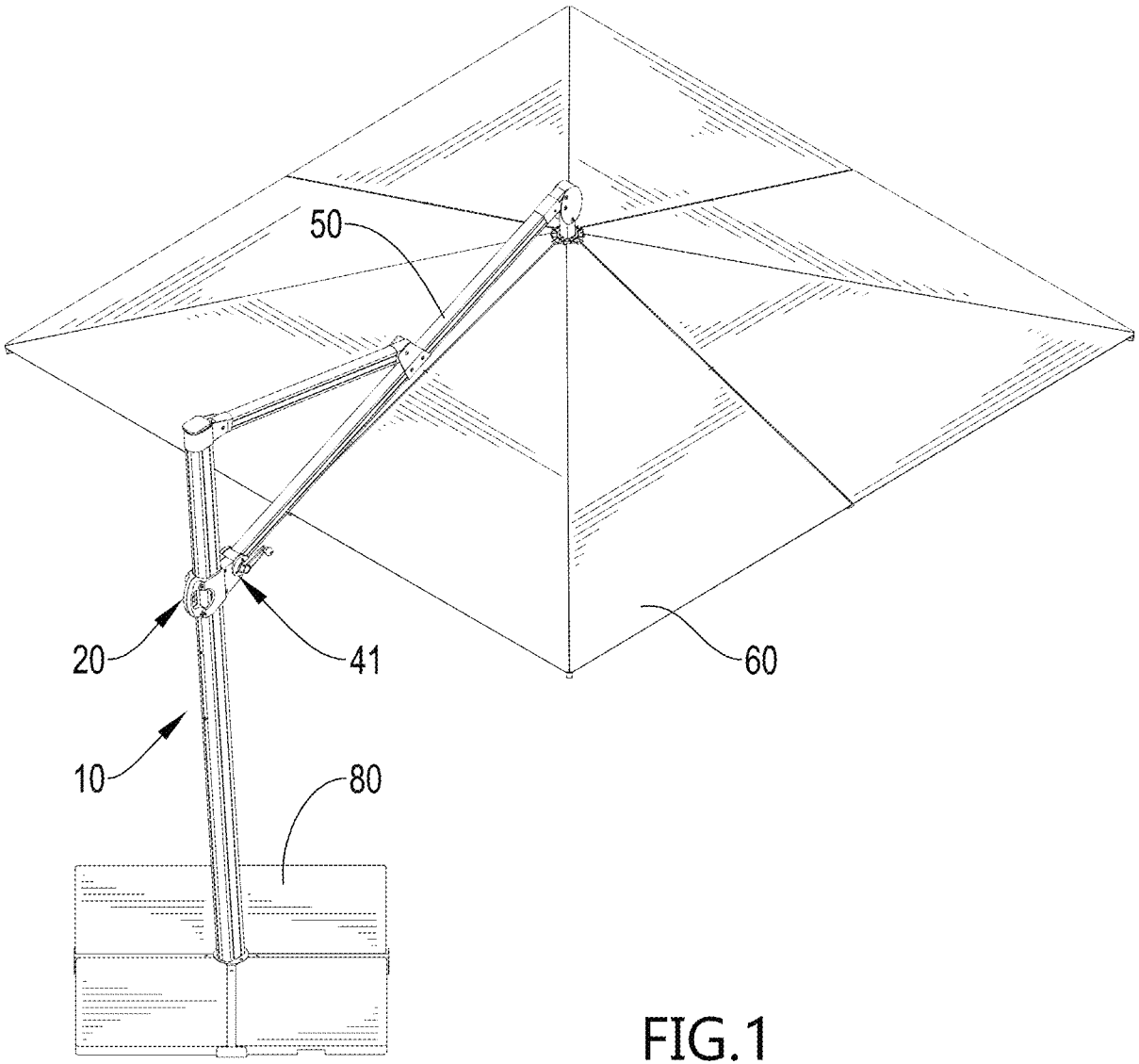
FIG. 1 is a perspective view of a preferred embodiment of a cantilever umbrella in accordance with the present invention.
Figure 2:
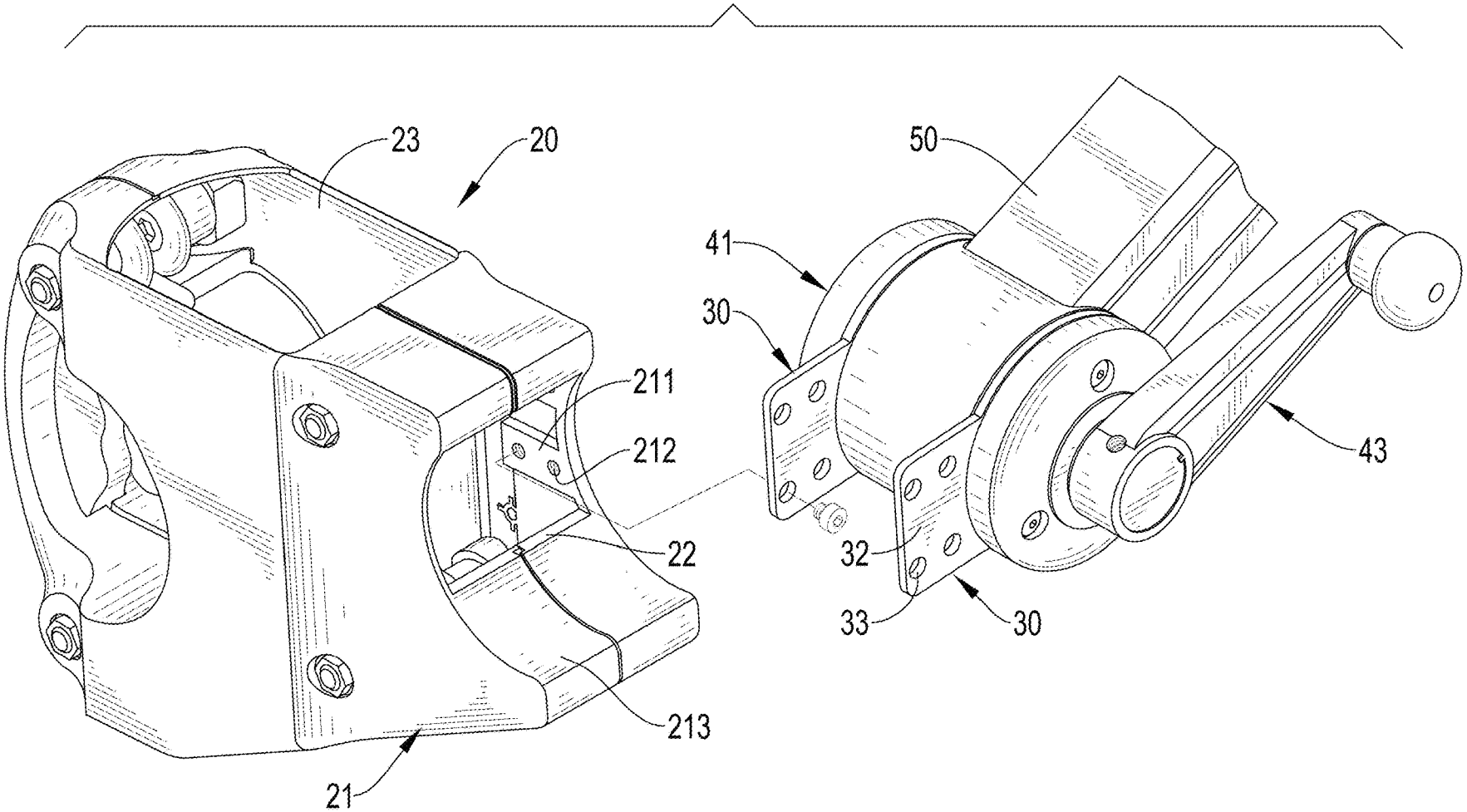
FIG. 2 is an exploded view of a slider and a handle mechanism of the cantilever umbrella in FIG. 1.

With reference to FIGS. 1 and 2, a preferred embodiment of a cantilever umbrella in accordance with the present invention has a pole 10, a slider 20, a handle mechanism, a support arm 50, and an umbrella body 60. The slider 20 is disposed on the pole 10, and the handle mechanism is disposed to the slider 20. The support arm 50 is connected to the handle mechanism, and the umbrella body 60 is disposed to the support arm 50.

With reference to FIG. 1, the pole 10 is the main support of the cantilever umbrella. In the preferred embodiment, the pole 10 is mounted on a base 80 to be placed stably on the ground. In other embodiments, the pole 10 may be mounted on a table or directly inserted into the ground according to types or applications of the cantilever umbrella, which is not limited to the preferred embodiment.

Figure 8:
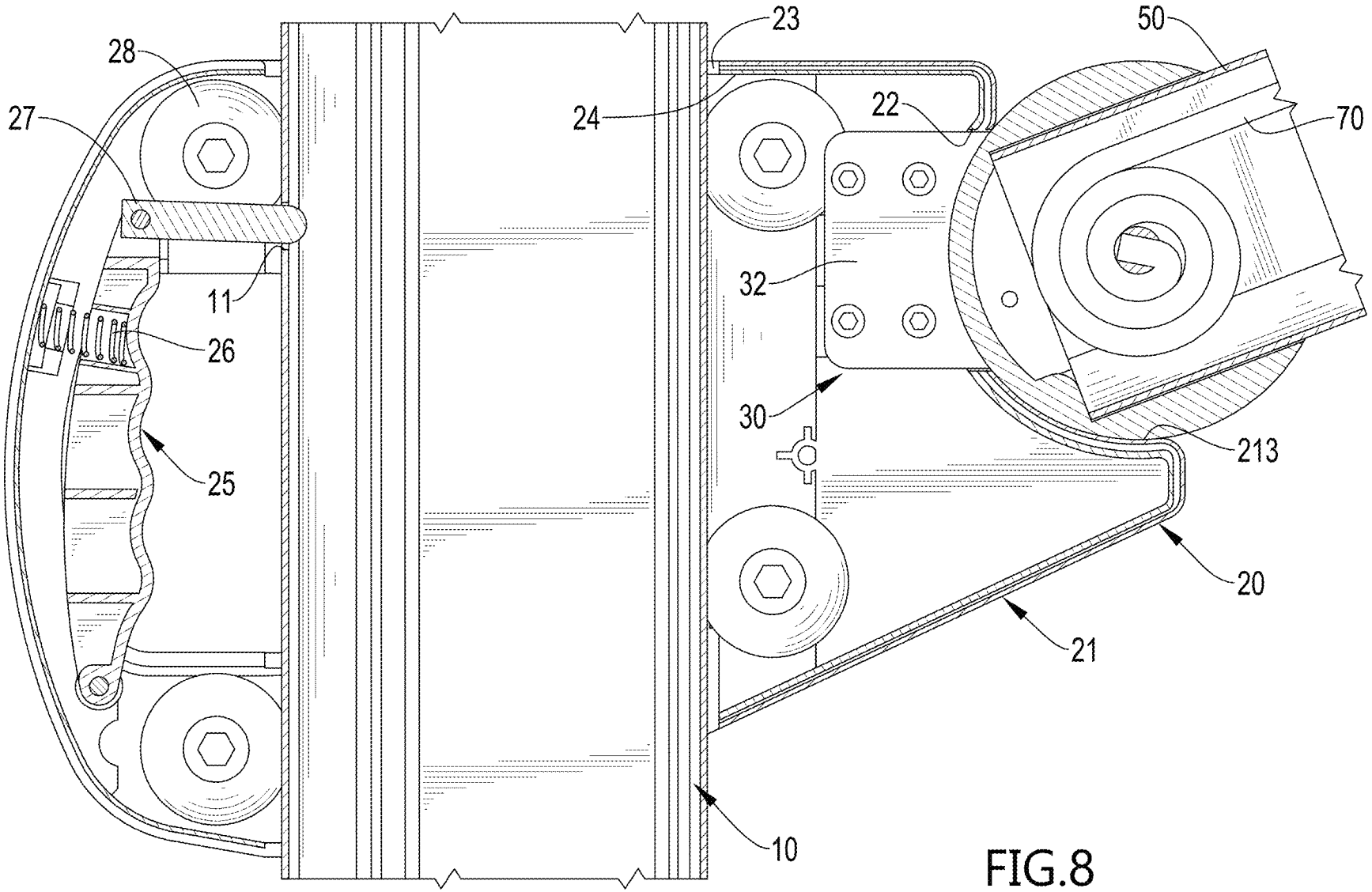
FIG. 8 is a sectional side view of the slider of the cantilever umbrella in FIG. 1.
Figure 9:
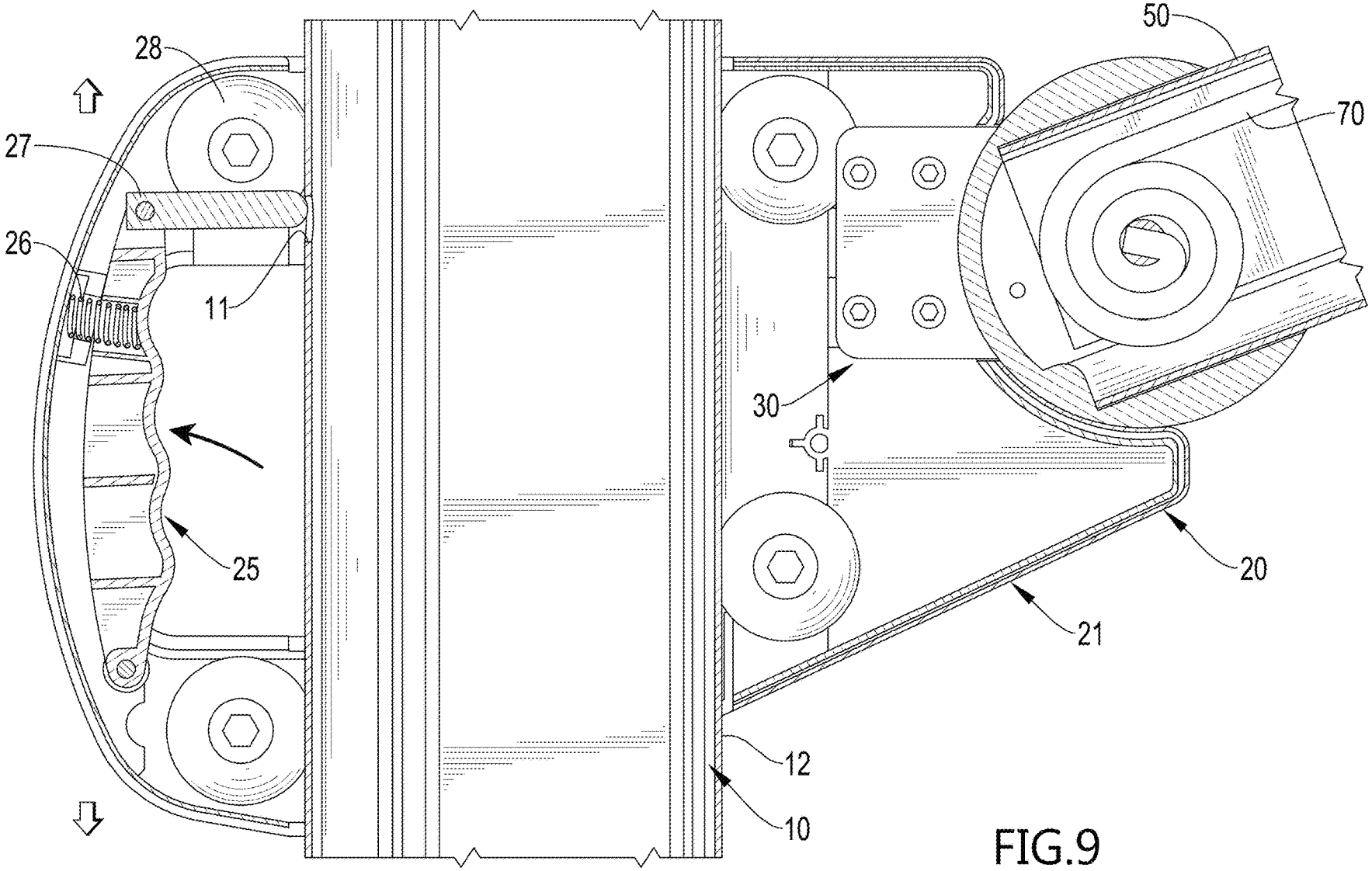
FIG. 9 is an operational view of the slider of the cantilever umbrella in FIG. 1.

With reference to FIGS. 1, 8, and 9, the slider 20 is disposed on the pole 10. The slider 20 is configured to be locked on the pole 10 and also configured to be unlocked and slide along the pole 10. Specifically, the slider 20 is connected with the support arm 50 via the handle mechanism. Positions of the support arm and the umbrella body 60 can be maintained or adjusted by locking or unlocking the slider 20 on or from the pole 10.

Figure 3:
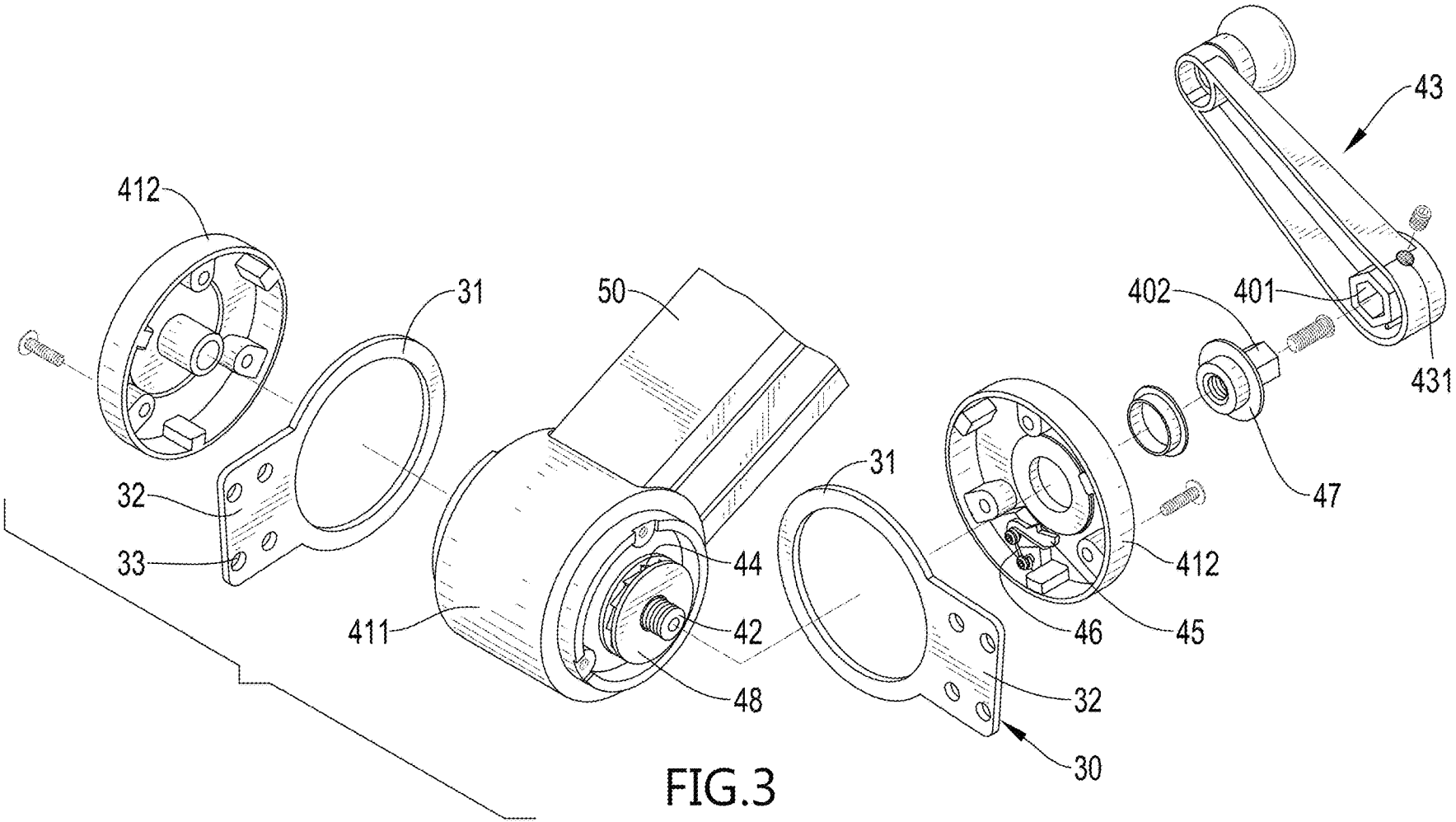
FIG. 3 is an exploded view of the handle mechanism of the cantilever umbrella in FIG. 1.
Figure 5:
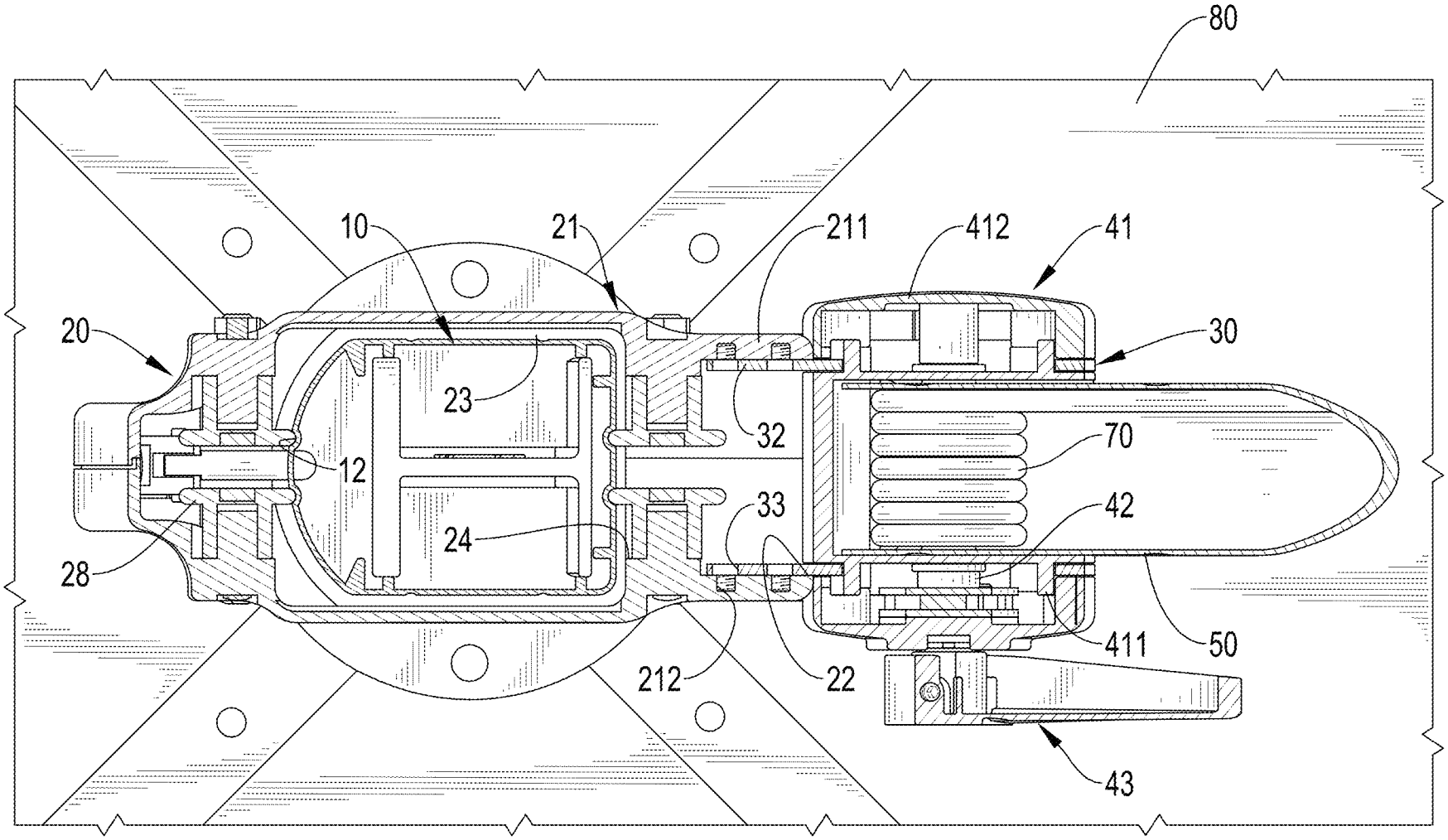
FIG. 5 is a sectional top side view of the cantilever umbrella in FIG. 1.

With reference to FIGS. 2, 3, and 5, the handle mechanism has at least one connecting rack 30, a handle seat 41, and a handle assembly. Said connecting rack 30 is fixed to the slider 20. Specifically, in the preferred embodiment, said connecting rack 30 extends from an exterior of the slider 20 into the slider 20 to be fixed to the slider 20, and a portion of said connecting rack 30 is located outside the slider 20. In other embodiments, said connecting rack 30 may be completely located outside the slider 20 and fixed to an outer surface of the slider 20, which is not limited to the preferred embodiment.

With reference to FIGS. 2, 3, and 5, the handle seat 41 is an independent component outside the slider 20, which means that the handle seat 41 and the slider 20 are individually manufactured and machined first and are assembled with each other after manufacturing. The handle seat 41 is rotatably mounted to at least a portion of said connecting rack 30 outside the slider 20. The handle assembly is disposed to the handle seat 41 and is operable to rotate relative to the handle seat 41.

Specifically, the handle assembly has a shaft 42 and a handle 43. The shaft 42 is rotatably disposed inside the handle seat 41, and the handle 43 is connected with the shaft 42 and located outside the handle seat 41 for operation of opening and closing the umbrella body 60.

With reference to FIGS. 3 to 6, the support arm 50 is a portion of a cantilever mechanism of the cantilever umbrella. Other components of the cantilever mechanism may refer to different types of cantilever mechanisms in conventional cantilever umbrellas. The umbrella body 60 may have a canopy and multiple ribs. Configurations of the umbrella body 60 may refer to different types of conventional cantilever umbrellas.

The support arm 50 is connected to the handle seat 41. Since the handle seat 41 is rotatably mounted to said connecting rack 30, the support arm 50 and the handle seat 41 are configured to swing relative to the slider 20 and said connecting rack 30 for adjusting the position of the support arm 50 and the umbrella body 60.

Figure 4:
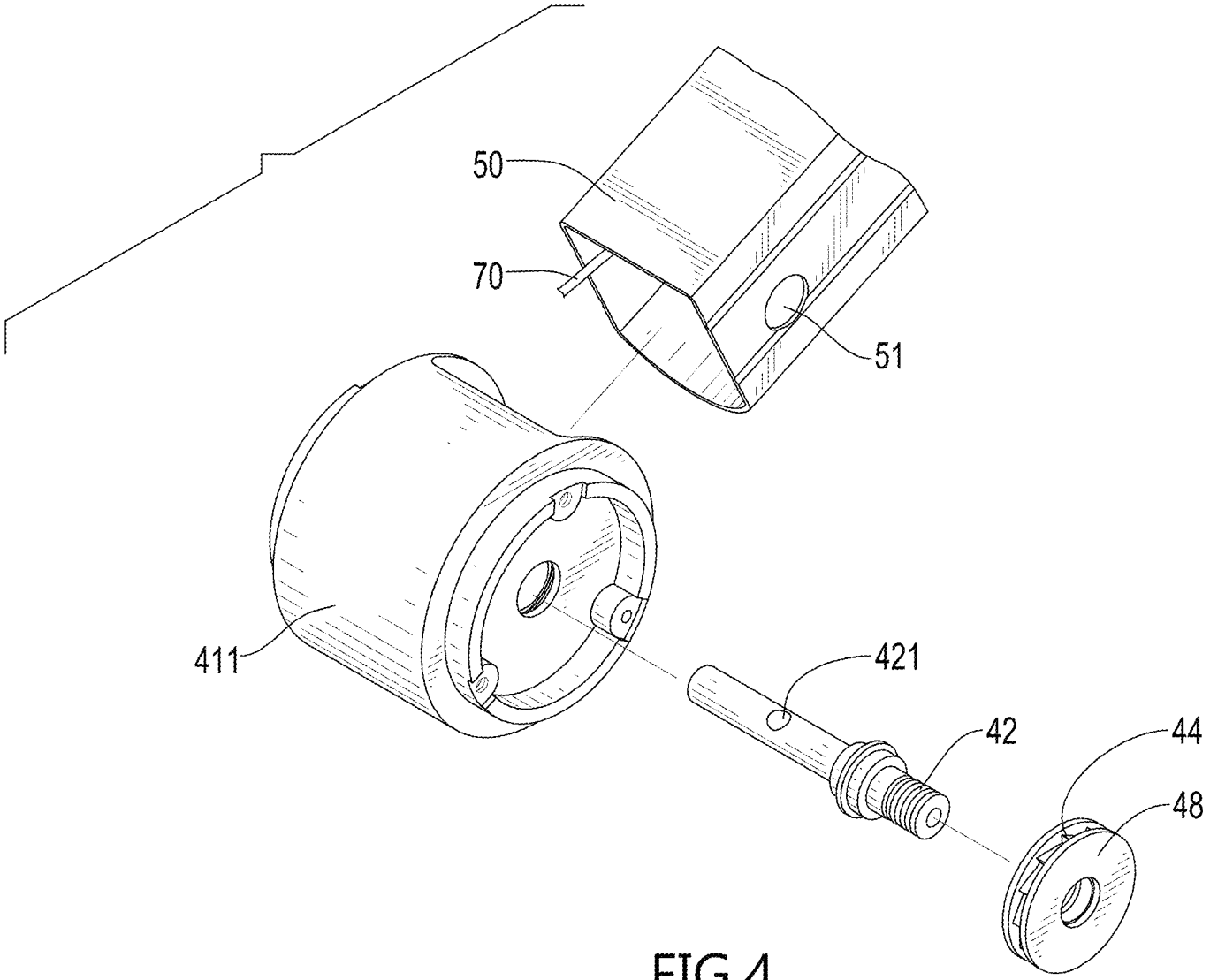
FIG. 4 is an exploded view of the handle mechanism and a support arm of the cantilever umbrella in FIG. 1.
Figure 6:
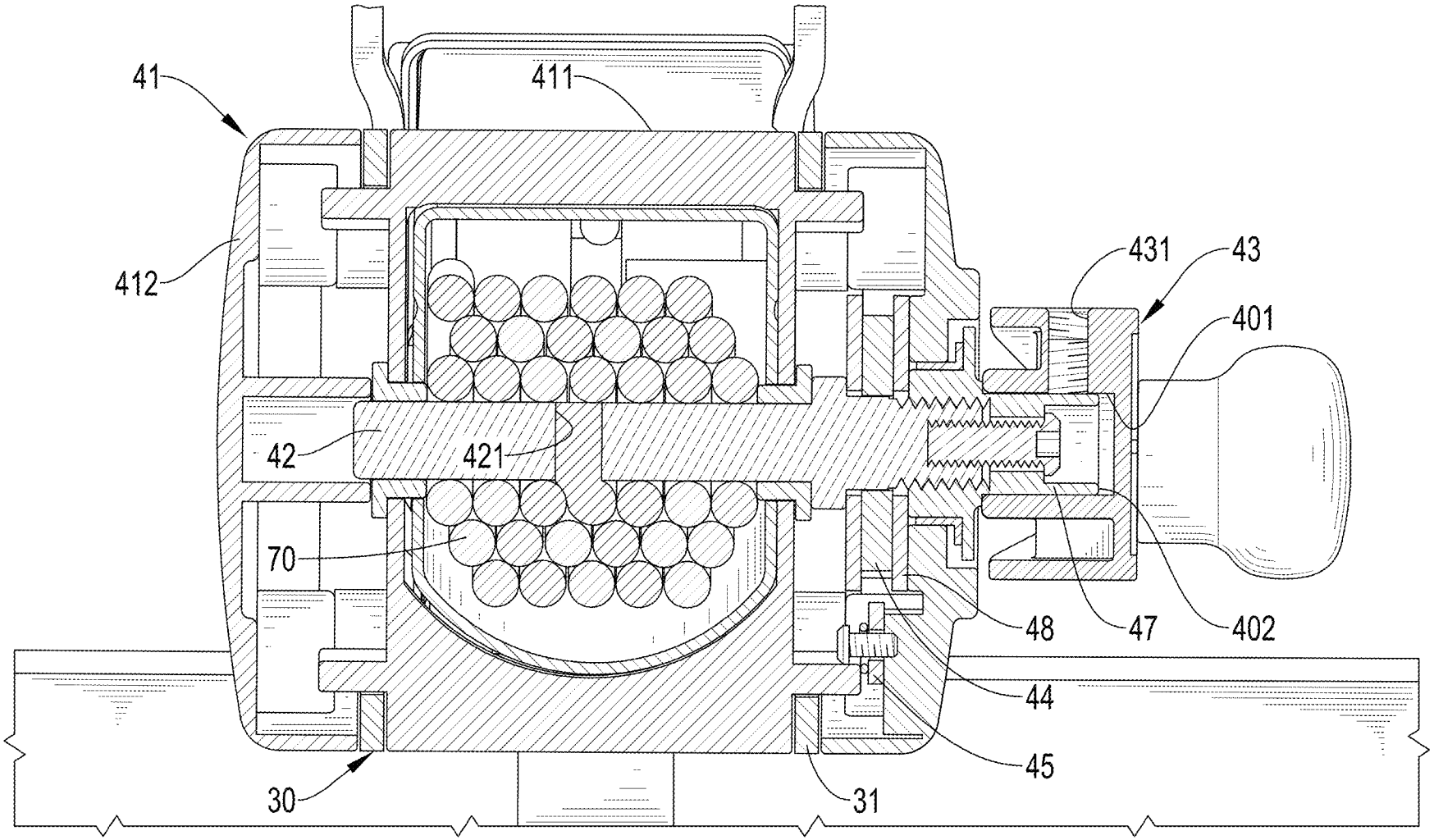
FIG. 6 is a sectional side view of the handle mechanism of the cantilever umbrella in FIG. 1.

With reference to FIGS. 4 to 6, in the preferred embodiment, the handle seat 41 forms an opening communicating with its interior. The support arm 50 is inserted into the interior of the handle seat 41 from the opening and has two mount holes 51 formed on its two opposite sides and aligned with each other. The shaft 42 in the handle seat 41 is mounted through the two mount holes 51, so the support arm 50 is stably connected to the handle seat 41.

With reference to FIGS. 4 to 6, to open and close the umbrella body 60, the cantilever umbrella has a cord 70 or a cable such that the umbrella body 60 can be connected with the shaft 42 of the handle assembly via the cord 70. In the preferred embodiment, the shaft 42 forms a cord hole 421 for fixing the cord 70. The cord 70 is wound around the shaft 42 and extends inside and along the support arm 50 to be connected to the umbrella body 60. Thus, when operating the handle assembly, the cord 70 can either be retracted or released to open or close the umbrella body 60.

When assembling the cantilever umbrella in accordance with the present invention, by said connecting rack 30 being fixed to the slider 20, the handle seat 41, the handle assembly, the support arm 50, and the cord 70 can be assembled outside the slider 20 and mounted to a portion of said connecting rack 30 outside the slider 20. After finishing the whole assembling, the cantilever umbrella can be used as a sunshade or a rainshade according to the weather.

With the aforementioned features, the cantilever umbrella in accordance with the present invention has the following efficacies:

1. Compared to the conventional cantilever umbrella having the shaft disposed in the slider, in the cantilever umbrella in accordance with the present invention, the handle seat 41 and said connecting rack 30 allow the handle mechanism to be assembled outside the slider 20. Space of assembling the handle mechanism is not limited inside the slider 20, and assembling of the handle mechanism can thus be simpler and more convenient.
2. Since the shaft 42 of the handle assembly and the support arm 50 are both disposed to the handle seat 41 outside the slider 20, the cord 70 extending from the shaft 42 and along the support arm 50 need not be bent to avoid components or structures inside the slider 20. Thereby, when rotating the handle assembly, the cord 70 can be retracted or released more fluently to open or close the umbrella body 60, which improves convenience in operation.

With reference to FIGS. 2, 3, and 5, in the preferred embodiment, each one of said connecting racks 30 is sheet-shaped and has an annular portion 31 and a connecting portion 32 connected to each other. The handle seat 41 has a seat body 411 and at least one cap 412. The connecting portion 32 extends into the slider 20, and the annular portion 31 is rotatably sheathed onto the seat body 411. Said cap 412 is fixed to the seat body 411 and limits a position of the annular portion 31 of said connecting rack 30 between the seat body 411 and said cap 412. Thereby, the handle seat 41 can be mounted to and also configured to rotate relative to said connecting rack 30.

In other embodiments, the handle seat 41 may be rotatably mounted to said connecting rack 30 via a pivot shaft or via other structures on the handle seat 41 and said connecting rack 30, which is not limited to the preferred embodiment. In the preferred embodiment, the simple designs of the annular portion 31, the seat body 411, and said cap 412 may improve convenience in manufacture and assembling.

Also, in the preferred embodiments, the handle mechanism has two said connecting racks 30. Said annular portions 31 of the two connecting racks 30 are respectively sheathed onto two opposite ends of the seat body 411. The handle seat 41 has two said caps 412. Each one of the two caps 412 limits the position of the annular portion 31 of a respective one of the two connecting racks 30 between the seat body 411 and said cap 412. The two connecting racks 30 may strengthen structure of the handle mechanism after being assembled together and allow the handle mechanism to be mounted to the slider 20 more stably.

With reference to FIGS. 2 and 5, for fixing said connecting racks 30 to the slider 20, the slider 20 has multiple protrusions 211 on its shell 21 and multiple mount holes 212 respectively formed on the multiple protrusions 211. Said connecting rack 30 has multiple through holes 33 formed on the connecting portion 32. The connecting portion 32 abuts the corresponding protrusions 211. Each one of the multiple through holes 33 is aligned with a respective one of the multiple mount holes 212 and is configured for a bolt to be mounted therethrough and screwed into the corresponding mount hole 212, which allows said connecting rack 30 to be fixed to the slider 20.

With the multiple protrusions 211, the shell 21 of the slider 20 has enough space to form said mount holes 212 with sufficient depths, which allows said connecting rack 30 to be stably fixed to the slider 20. Also, the multiple protrusions 211 for the connecting portion 32 to abut may improve strength of the portions of the shell 21 for fixing said connecting rack 30. Thereby, other portions of the shell 21 can be designed thinner to reduce cost of production.

Moreover, with reference to FIGS. 2 and 8, the shell 21 of the slider 20 may form a recess 213 being arc-shaped. The handle seat 41 is cylindrical and is placed in the recess 213 of the shell 21. With the arc-shaped recess 213, the slider 20 can directly support the handle seat 41. Strength of supporting the handle seat 41 located outside the slider 20 can still be guaranteed.

With reference to FIGS. 2, 5, and 8, specifically, the slider 20 has the shell 21 and a first opening 22. The shell 21 is composed of two shell halves detachably connected to each other. The first opening 22 is formed on a side of the shell 21 and is formed by the two shell halves. The connecting portion 32 of said connecting rack 30 extends into the slider 20 from the first opening 22 to be fixed to the slider 20.

By the first opening 22 formed by the two shell halves of the shell 21, said connecting rack 30 can be placed between the two shell halves and fixed to at least one of the two shell halves before the two shell halves are connected to each other. Thus, convenience of assembling the handle mechanism and the slider 20 can be further improved. Also, the two shell halves can be easily detached for maintenance or replacement of components inside the slider 20.

In this preferred embodiment, when assembling, one of the two shell halves and one of the two connecting racks 30 are fixed with each other and placed on a side of the pole 10 first. Then, the handle seat 41 can be placed to said connecting rack 30. Afterwards, the other one of the two shell halves and the other one of the two connecting racks 30 are fixed with each other and placed on the other side of the pole 10. After the two shell halves are fixed together, the handle seat 41 can be stably mounted on the two connecting racks 30, and the handle assembly, other components of the handle mechanism, and the support arm 50 can be mounted to the handle seat 41 outside the slider 20 later.

In addition, with reference to FIGS. 8 and 9, the pole 10 has multiple positioning holes 11 along its height, and the slider 20 further has an operating component 25, an elastic element 26, and a positioning pin 27 for positioning. The operating component 25 is movably disposed to the shell 21. The elastic element 26 is disposed between the shell 21 and the operating component 25. The positioning pin 27 is connected to the operating component 25 and is configured to be inserted into one of the multiple positioning holes 11.

In the preferred embodiment, the operating component 25 is specifically a hand grip, and the elastic element 26 is specifically a compression spring. In other embodiments, the operating component 25 may be a handle, a button, or other components, and the elastic element 26 may be any other type of spring or component.

When operating the operating component 25, the operating component 25 moves relative to the shell 21 to compress the elastic element 26 and drive the positioning pin 27 to depart from said positioning hole 11, which allows the slider 20 to be unlocked from the pole 10 for adjusting its position. When the operating component 25 is released from operation, the operating component 25 is pushed back to an original position by the elastic element 26. Thence, the positioning pin 27 is re-inserted into another one of the multiple positioning holes 11 to position the slider 20 on the pole 10 again.

In other embodiments, the slider 20 may be positioned on the pole 10 by simply mounting a pin through the slider 20 and to the pole 10 or by an extra clamp. In the preferred embodiment, the slider 20 can be re-positioned by only releasing the operating component 25 after adjustment, which improves convenience of positioning the slider 20.

Figure 7:
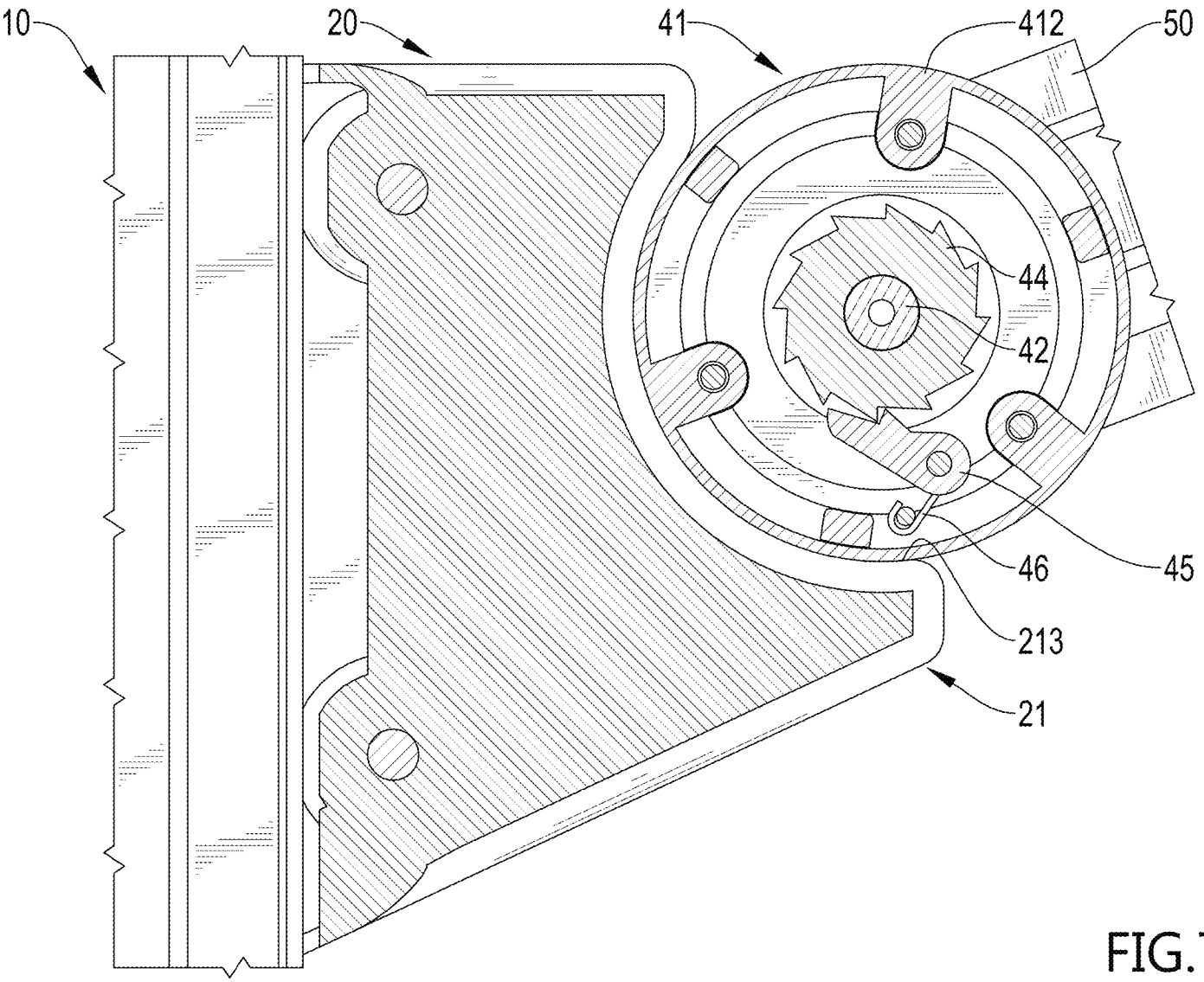
FIG. 7 is a sectional side view of a ratchet wheel and a pawl of the handle mechanism of the cantilever umbrella in FIG. 1.

Besides, with reference to FIGS. 4, 6, and 7, the handle mechanism has a ratchet wheel 44 and a pawl 45 matching each other. The ratchet wheel 44 is disposed on the shaft 42 of the handle assembly and is configured to rotate synchronously with the shaft 42. The pawl 45 is pivotally disposed to the handle seat 41, and a torsion spring 46 is disposed between the pawl 45 and the handle seat 41 for pushing the pawl 45 toward the ratchet 44. The pawl 45 is configured to limit the ratchet wheel 44 to rotate in only one direction.

In use, when the handle 43 and the shaft 42 of the handle assembly are operated to rotate forward, the ratchet wheel 44 rotates as well, abuts the pawl 45, and passes by the pawl 45. When the handle assembly is released, the pawl 45 can be engaged with the ratchet wheel 44 to prevent the ratchet wheel 44 and the handle assembly from rotating backward. Thereby, the handle 43 of the handle assembly can be prevented from springing backward right after releasing the handle 43.

More specifically, the handle mechanism has a nut 47 and two spacers 48. The handle 43 is connected to the shaft 42 via the nut 47 so as to drive the shaft 47 to rotate. The two spacers 48 respectively abut on two opposite sides of the ratchet wheel 44, and the ratchet wheel 44 along with the two spacers 48 is clamped between the nut 47 and the shaft 42. Hence, the ratchet wheel 44 is configured to rotate synchronously with the shaft 42 due to friction forces among said spacers 48, the ratchet wheel 44, the nut 47, and the shaft 42.

Additionally, among the above configurations, each one of the ratchet wheel 44 and the two spacers 48 has a circular hole surrounding the shaft 42. When the handle 43 and the shaft 42 of the handle assembly are operated to rotate backward, the ratchet wheel 44 is engaged with and limited by the pawl 45 to stay stationary. At the time, if the force acted on the handle 43 and the shaft 42 is sufficient to overcome the friction forces among said spacers 48, the nut 47, and the shaft 42, the handle assembly can rotate backward relative to the ratchet wheel 44 and the spacers 48. The umbrella body 60 can be opened and closed by rotating the handle assembly forward and backward.

Preferably, with reference to FIGS. 3 and 6, the handle mechanism has an insert hole 401 and an insert portion 402 respectively formed on the handle 43 and the nut 47. In the preferred embodiment, the insert hole 401 is formed on the handle 43, and the insert portion 402 is formed on the nut 47. The insert portion 402 has a non-circular structure to match and be inserted into the insert hole 401 such that the nut 47 and the handle 43 rotate synchronously. Thereby, when operating the handle 43, rotation is ensured to be transmitted to the nut 47 and then to the shaft 42.

In addition, the handle 43 forms a side hole 431 extending to the insert hole 401. A bolt can be screwed in and mounted through the side hole 431 so as to abut the insert portion 402. Thereby, the handle 43 and the nut 47 can be fixed with each other more stably. Also, the nut 47 and the shaft 42 are fixed with each other via a threaded section and a bolt, wherein the threaded section and the bolt have two opposite threaded directions. Thus, the nut 47 and the shaft 42 can be prevented from detachment during rotation.

Besides, with reference to FIGS. 5 and 8, the slider 20 further has multiple rollers 28 rotatably disposed inside the shell 21. The pole 10 further has multiple slide guides 12 recessed thereon. The multiple rollers 28 are respectively disposed in the multiple slide guides 12. When the slider 20 is unlocked from the pole 10 and slides along the pole 10, each one of the multiple rollers 28 moves along the corresponding slide guide 12, which improves accuracy of sliding and reduces friction between the slider 20 and the pole 10.

With reference to FIGS. 2, 5, and 8, the slider 20 has a slideway 23 and a second opening 24. The slideway 23 is formed through the shell 21, and the pole 10 is mounted through the slideway 23. The second opening 24 is formed inside the shell 21, communicates with the slideway 23, and is spaced from the first opening 22.

The slider 20 has an interior space formed between the first opening 22 and the second opening 24. The two connecting racks 30 extend to the interior space. The multiple protrusions 212 are formed on the inner side of the shell 21 and located between the first opening 22 and the second opening 24 for the two connecting racks 30 to be fixed thereto. A part of the multiple rollers 28 is located through the second opening 24.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cantilever umbrella comprising:

a pole;

a slider disposed on the pole, configured to be locked on the pole, and configured to be unlocked and slide along the pole;

a handle mechanism having at least one connecting rack fixed to the slider;

a handle seat being an independent component outside the slider and rotatably mounted to the at least one connecting rack; and a handle assembly disposed to the handle seat and being operable to rotate relative to the handle seat;

a support arm connected to the handle seat; and an umbrella body disposed to the support arm and connected with the handle assembly via a cord; wherein the handle seat has a seat body and at least one cap;

said connecting rack has a connecting portion extending into the slider to be fixed with the slider; and an annular portion connected to the connecting portion and rotatably sheathed onto the seat body; and said cap is fixed to the seat body to limit a position of the annular portion between the seat body and said cap.

2. The cantilever umbrella as claimed in claim 1, wherein the handle mechanism comprises two said connecting racks respectively disposed near two opposite ends of the handle seat.

3. The cantilever umbrella as claimed in claim 1, wherein the handle mechanism has two said connecting racks;

said annular portions of the two connecting racks are respectively sheathed onto two opposite ends of the seat body of the handle seat;

the handle seat has two said caps; and each one of the two caps limits a position of the annular portion of a respective one of the two connecting racks between the seat body and said cap.

4. The cantilever umbrella as claimed in claim 1, wherein the slider has multiple protrusions and multiple mount holes respectively formed on the multiple protrusions;

said connecting rack has multiple through holes;

each one of the multiple through holes is aligned with a respective one of the multiple mount holes and is configured for a bolt to be mounted therethrough and be screwed in the corresponding mount hole.

5. The cantilever umbrella as claimed in claim 1, wherein the slider has a shell composed of two shell halves; and a first opening formed on a side of the shell and jointly formed by the two shell halves; and said connecting rack extends into the slider from the first opening to be fixed to the slider.

6. The cantilever umbrella as claimed in claim 1, wherein the pole has multiple slide guides recessed thereon;

the slider has multiple rollers; and each one of the multiple rollers is disposed in a respective one of the multiple slide guides and configured to move along the corresponding slide guide when the slider is unlocked from the pole.

7. The cantilever umbrella as claimed in claim 1, wherein the pole has multiple positioning holes spaced from each other;

the slider has a shell;

an operating component disposed to the shell;

an elastic element disposed between the operating component and the shell; and a positioning pin connected to the operating component and configured to be inserted into one of the multiple positioning holes; and the operating component is movable relative to the shell to compress the elastic element and drives the positioning pin to depart from said positioning hole.

8. The cantilever umbrella as claimed in claim 1, wherein the handle mechanism has a ratchet wheel and a pawl matching each other;

the ratchet wheel is disposed on and configured to rotate synchronously with the handle assembly; and the pawl is disposed to the handle seat and configured to limit the ratchet wheel to rotate unidirectionally.

9. The cantilever umbrella as claimed in claim 8, wherein the handle assembly has a handle, a shaft, and a nut;

the handle is connected to the shaft via the nut so as to drive the shaft to rotate; and the ratchet wheel is clamped between the nut and the shaft to be drivable by the shaft to rotate.

10. The cantilever umbrella as claimed in claim 9, wherein the handle mechanism has an insert portion and an insert hole;

the insert portion and the insert hole are respectively formed on the nut and the handle; and the insert portion has a non-circular contour to match and be inserted into the insert hole such that the nut and the handle rotate together.

* * * * *